US006998529B2

(12) United States Patent
Wnorowski

(10) Patent No.: US 6,998,529 B2
(45) Date of Patent: Feb. 14, 2006

(54) METHOD FOR SWITCHING ELECTRIC GUITAR PICKUPS

(76) Inventor: Thomas Fredrick Wnorowski, 3177 Chelsea Cir., Ann Arbor, MI (US) 48108

( * ) Notice: Subject to any disclaimer, the term of this patent is extended or adjusted under 35 U.S.C. 154(b) by 221 days.

(21) Appl. No.: 10/191,375

(22) Filed: Jul. 8, 2002

(65) Prior Publication Data

US 2003/0145715 A1 Aug. 7, 2003

Related U.S. Application Data

(60) Provisional application No. 60/306,536, filed on Jul. 20, 2001.

(51) Int. Cl.
*G10H 3/18* (2006.01)

(52) U.S. Cl. ..... 84/726; 84/727

(58) Field of Classification Search ..... 84/726, 84/727, 728

See application file for complete search history.

(56) References Cited

U.S. PATENT DOCUMENTS 3,915,048 A * 10/1975 Stich ..... 84/728
4,151,776 A * 5/1979 Stich ..... 84/728
4,164,163 A * 8/1979 Rhodes ..... 84/728
4,175,462 A * 11/1979 Simon ..... 84/728
4,222,301 A * 9/1980 Valdez ..... 84/728
4,319,510 A * 3/1982 Fender ..... 84/728
4,581,975 A * 4/1986 Fender ..... 84/725
5,136,918 A * 8/1992 Riboloff ..... 84/723
5,311,806 A * 5/1994 Riboloff ..... 84/728
5,763,808 A * 6/1998 Thomson ..... 84/728
5,780,760 A 7/1998 Riboloff
5,898,121 A * 4/1999 Riboloff ..... 84/728
6,121,537 A * 9/2000 Pawar et al. ..... 84/728
6,316,713 B1 * 11/2001 Furst et al. ..... 84/726

FOREIGN PATENT DOCUMENTS

GB 2207542 A * 2/1989

* cited by examiner

*Primary Examiner*—Marlon T. Fletcher
*Assistant Examiner*—David S. Warren

(57) ABSTRACT

A guitar pickup switching system for a three pickup guitar has a bridge pickup, a middle pickup, and a neck pickup for an electric guitar. This invention utilizes a switch arrangement which permits the three pickup guitar player to select outputs of the pickups in any one of 29 series, parallel, in-phase, and/or out-of-phase combinations.

A guitar pickup switching system for a two pickup guitar has a bridge pickup and a neck pickup for an electric guitar. This invention utilizes a switch arrangement which permits the two pickup guitar player to select outputs of the pickups in any one of 6 series, parallel, in-phase, and/or out-of-phase combinations.

3 Claims, 7 Drawing Sheets

FIG. 1 – Revised Schematic For 3-Pickups
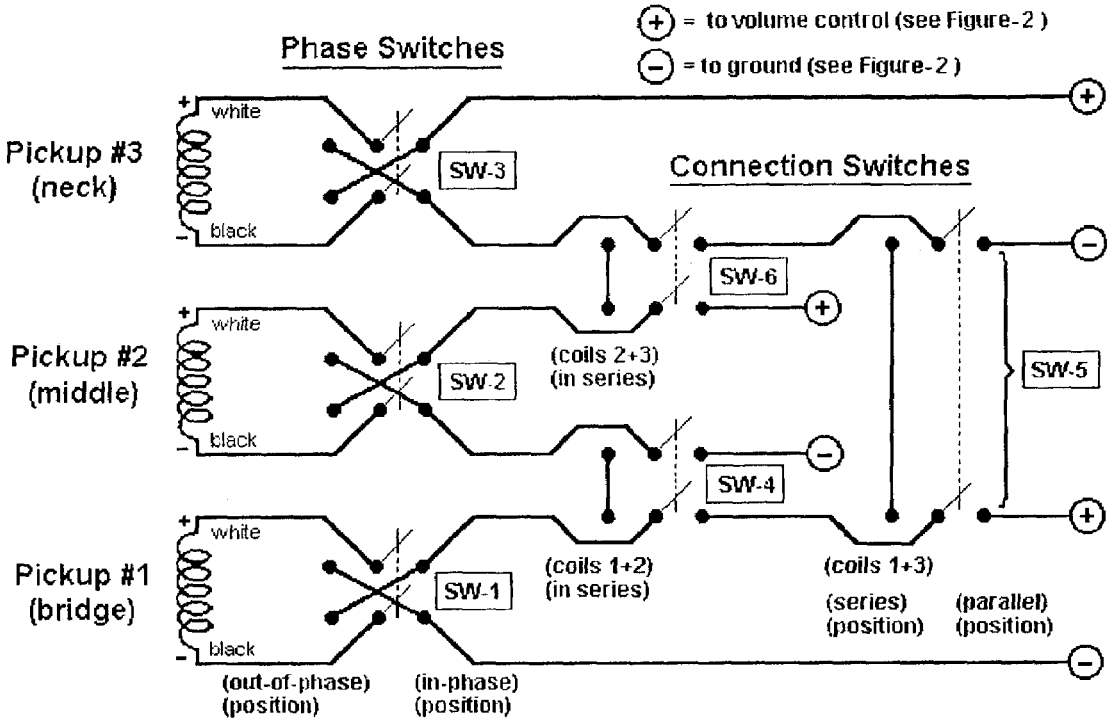

FIG. 2 – Wiring Diagram for 3-Pickups
(Control Plate - rear view)
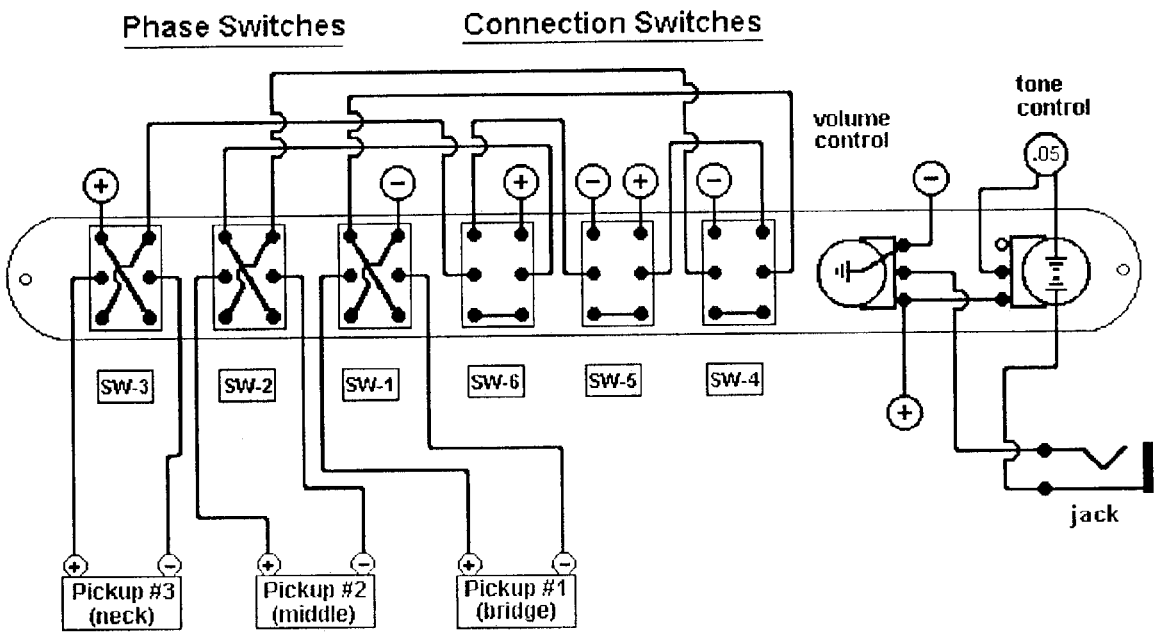

FIG. 3 - Revised Schematic For 2-Pickups
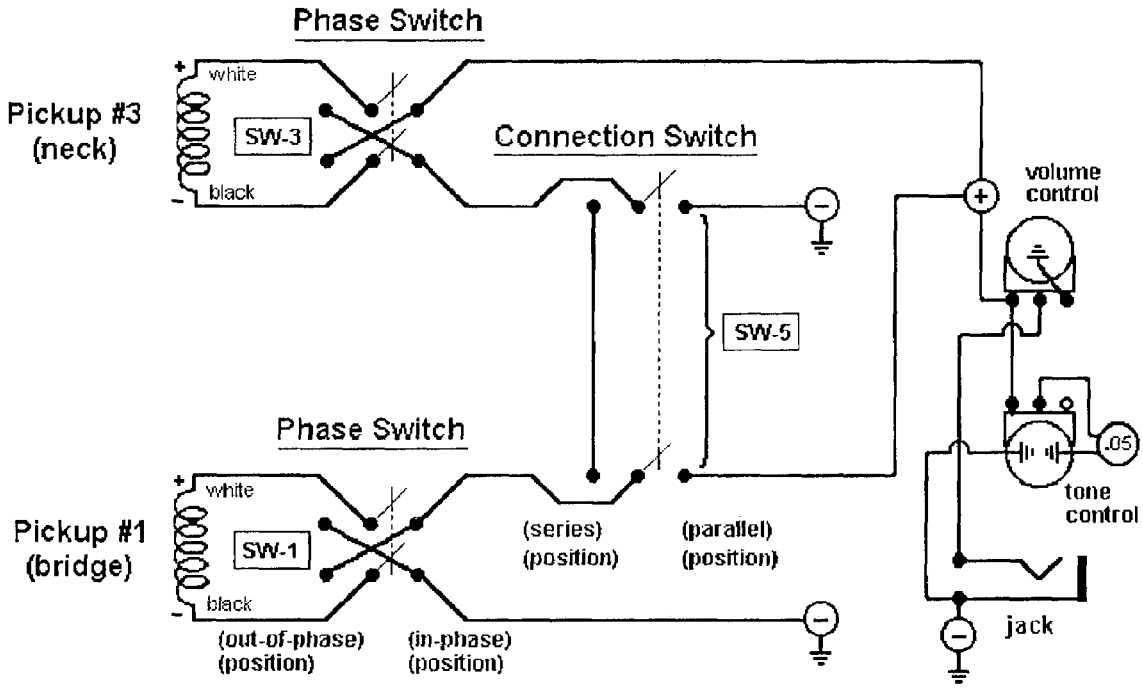

FIG. 4 – Wiring Diagram for 2-Pickups
(Control Plate - rear view)
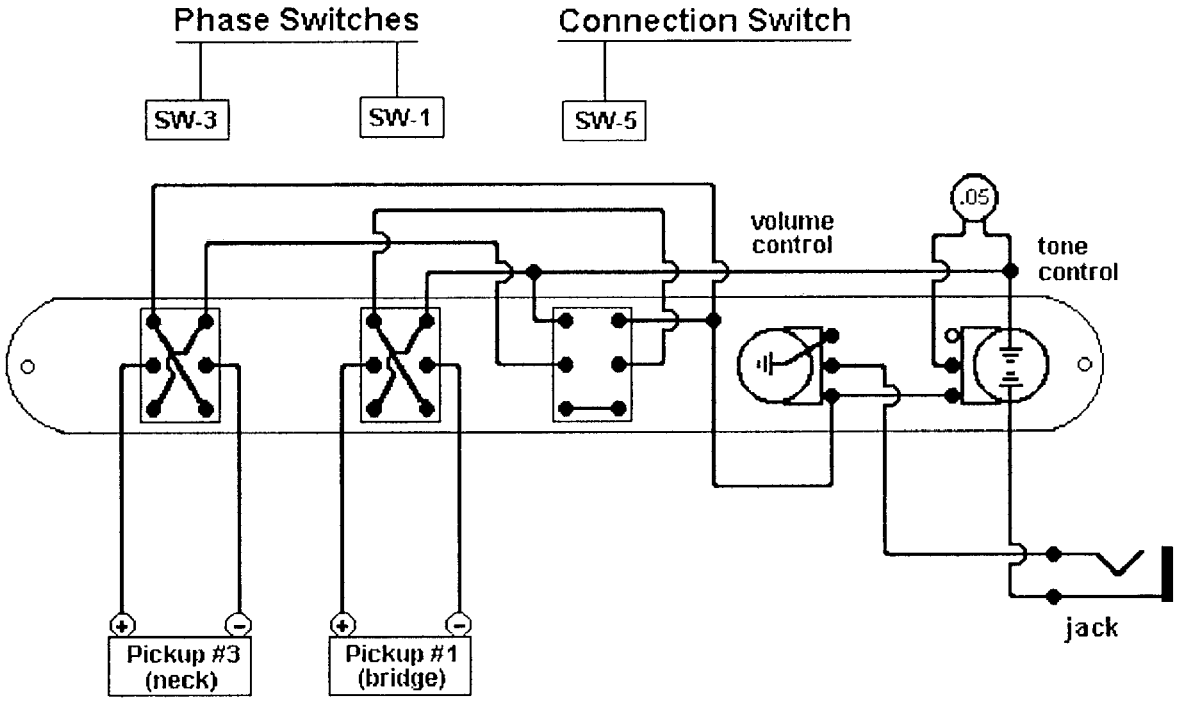

FIG. 5 – Revised Schematic For 2-Pickups
Using existing 3-way switch
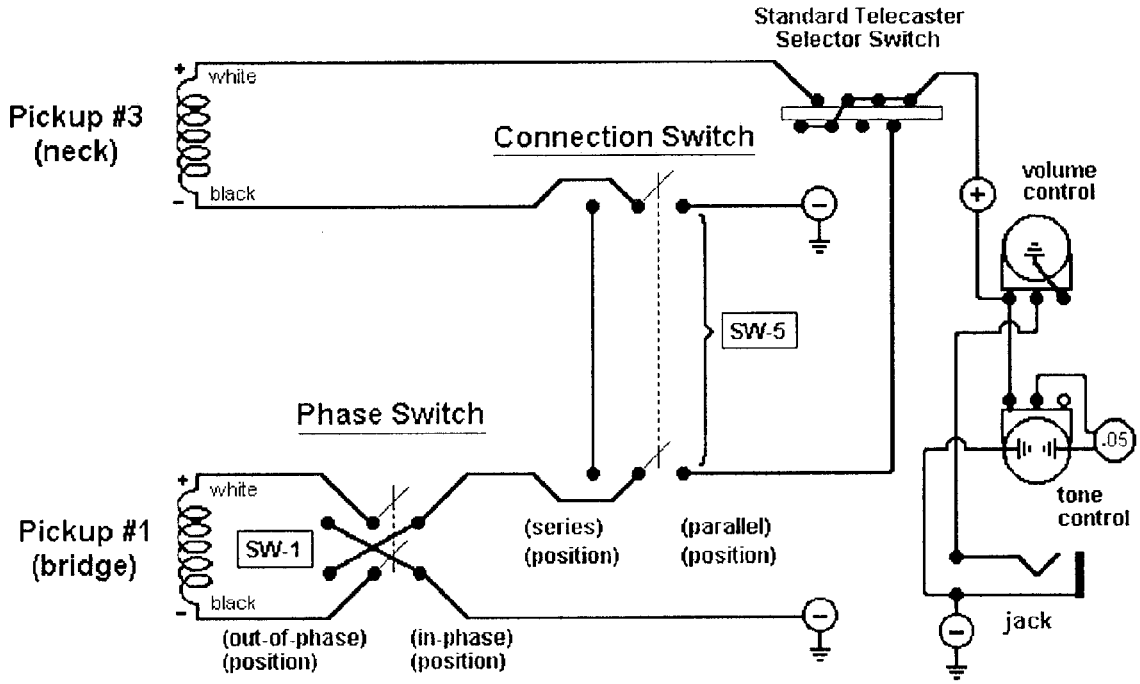

FIG. 6 – Wiring diagram for 2-Pickups using existing 3-way switch (Control Plate - rear view)
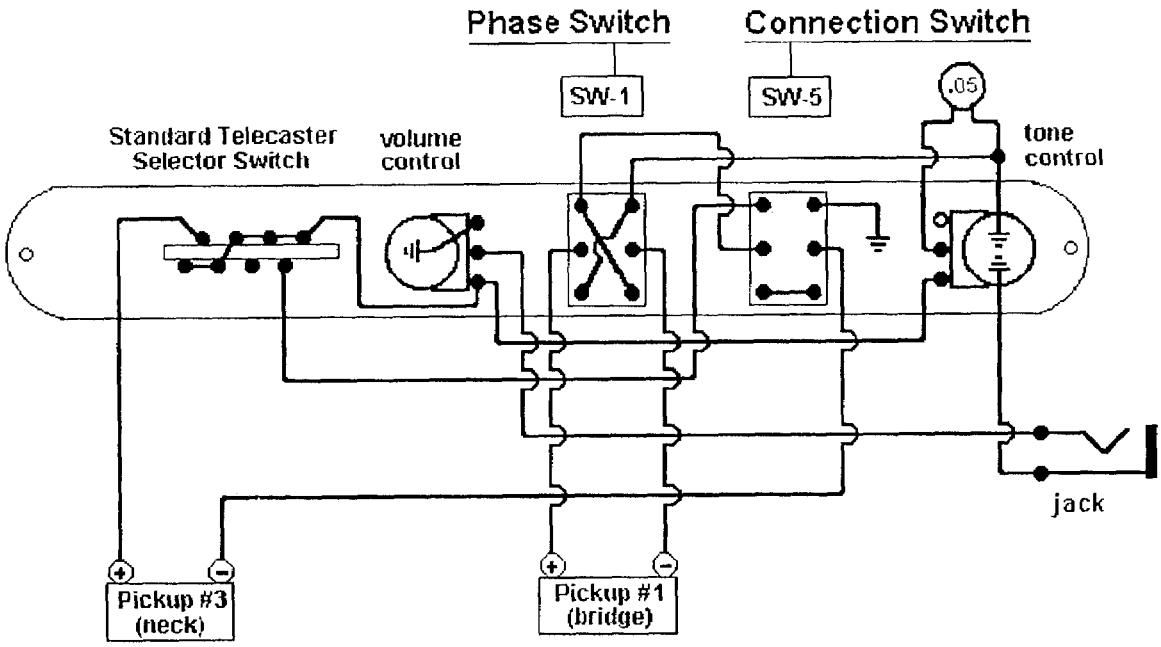

FIG. 7 - Switch Table (parallel connections) Phase Switches

| # of comb. | Pickups affected 3 | 2 | 1 |
|---|---|---|---|
| 1 | | | **SW-1A** |
| 2 | | SW-2A | |
| 3 | **SW-3A** | | |
| 4 | | SW-2A | SW-1A |
| 5 | **SW-3A** | | **SW-1A** |
| 6 | SW-3A | SW-2A | |
| 7 | SW-3A | SW-2A | SW-1A |
| 8 | | SW-2A | SW-1B |
| 9 | **SW-3A** | | **SW-1B** |
| 10 | SW-3A | SW-2B | |
| 11 | SW-3A | SW-2A | SW-1B |
| 12 | SW-3A | SW-2B | SW-1B |
| 13 | SW-3B | SW-2A | SW-1B |

(plus) (series connections) Connection Switches

| | Pickups affected 3 | 2 | 1 |
|---|---|---|---|
| 14 | | SW-4 | SW-4 |
| 15 | **SW-5** | | **SW-5** |
| 16 | SW-6 | SW-6 | |
| 17 | SW-6 | SW-6 + SW-4 | SW-4 |
| 18 | | SW-4 | SW-4 |
| 19 | **SW-5** | | **SW-5** |
| 20 | SW-6 | SW-6 | |
| 21 | SW-6 | SW-6 + SW-4 | SW-4 |
| 22 | SW-6 | SW-6 + SW-4 | SW-4 |
| 23 | SW-6 | SW-6 + SW-4 | SW-4 |

(series & parallel connections) Connection Switches

| | Pickups affected 3 | 2 | 1 |
|---|---|---|---|
| 24 | ***SW-3A*** | SW-4 | SW-4 |
| 25 | SW-5 | ***SW-2A*** | SW-5 |
| 26 | SW-6 | SW-6 | ***SW-1A*** |
| 27 | ***SW3B*** | SW-4 | SW-4 |
| 28 | SW-5 | ***SW-2B*** | SW-5 |
| 29 | SW-6 | SW-6 | ***SW-1B*** |

SW-xA = on position: in-phase
SW-xB = on position: out-of-phase
(where 'x' is the switch number from 1 - 3)

Pickup #1 = bridge position
Pickup #2 = middle position
Pickup #3 = neck position SW-x = pickups in series position
(where 'x' is the switch number from 4 - 6)

SW-4: puts Pickup #1 and Pickup #2 (bridge & middle) in series
SW-5: puts Pickup #1 and Pickup #3 (bridge & neck) in series
both SW-4 & SW-6: puts all three pickups in series (SW-5 has no effect)

Notes: a.) Switches in bold are for a 2-pickup guitar.
b.) An inversion of a Phase Switch combination will produce an identical sound.
c.) Combinations 1 thru 7 are in-phase, combinations 8 thru 13 are out-of-phase.
d.) When combinations 14 thru 23 are in series, it doubles the number of tones of the Phase Switches in the range of 4 thru 13.
e.) "series & parallel connections" includes parallel pickup (either phase) in series circuit. Switches in BOLD/ITALIC are Phase Switches which are added to the series connections

METHOD FOR SWITCHING ELECTRIC GUITAR PICKUPS

CROSS-REFERENCE TO RELATED APPLICATIONS

This application is related to (and references) the Provisional Application 60/306,536 filed on Jul. 20, 2001.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to electrical switching of electric guitar pickups which permits the configuration of all possible combinations of pickup connection; including any and all of the following:

Series connections of two or three pickups

Parallel connections of one, two or three pickups

In-phase connections of one, two or three pickups

Out-of phase connections of one, two or three pickups

The predominant electric guitars available today consist of either a two pickup variety or a three pickup variety. This can further be described by either a single-coil pickup or a multiple-coil pickup (commonly referred to as a "humbucker" pickup). Although this invention applies to both single-coil and multiple-coil pickups, for simplicity and brevity the illustrations and examples in this invention makes reference to single-coil pickups.

This invention makes use of "passive" switching (i.e., without electronic circuitry), making it more reliable and superior because no powered circuitry is required to produce a result.

Traditionally, a two-pickup guitar (or bass) utilizes a single pole, three-position switch to select and provide one of three unique pickup tones. This invention substitutes the three-position switch with two double-pole, double-throw (center off) switches; and one double-pole, double-throw switch to produce 6 unique pickup tones, which is a 100 percent increase in the number of unique pickup tones which can be obtained on a standard two pickup guitar.

On three pickup guitars, a five-position switch is used to select and provide one of five unique pickup tones. This invention substitutes the five-position switch with three double-pole, double-throw (center off) switches, and three double-pole, double throw switches to produce 29 unique pickup tones, which is a 580 percent increase in the number of unique pickup tones which can be obtained on a standard three pickup guitar. This permits the creation of a guitar that can reproduce the sound of virtually every electric guitar ever created. A full explanation of electric guitar pickup behavior is available on the web at www.Learn-Futures-.com.

BRIEF SUMMARY OF THE INVENTION

This is a useful and non-obvious invention. Although numerous pickup switching methods have been used in the industry, it has been on a rudimentary level with no one identifying a logical switching process of fully utilizing all the capabilities of electrically connecting guitar pickups in all possible configurations with an intuitive switch configuration.

This invention describes a switching method for total control of electrically connecting pickups in every possible configuration using a logical switching arrangement. This method is used to obtain additional tones from both a standard 2-pickup guitar and a 3-pickup guitar.

This invention implements all the possible combinations of electric guitar pickup connection, including "series" vs. "parallel" vs. "in-phase" vs. "out-of-phase" configurations to result in complete and total pickup switching control.

This invention uses "passive circuitry switching" which is superior for performance requirements because it avoids disruption due to dead batteries or defective electronics.

For simplicity, the switching examples contained in this specification refer to "single-coil" guitar pickups. However, this switching method is also applicable to "multi-coil" (i.e., "humbucking") guitar pickups.

A typical 3-pickup guitar uses a 5-way switch to select pickup #1 (bridge), pickup # 1 and #2 (bridge and middle), pickup #2 (middle), pickup #2 and #3 (middle and neck), pickup #3 (neck) which will produce five pickup tones. This invention permits a 3-pickup guitar to produce 29 unique pickup tones, a 580 percent increase in the number of unique pickup tones and can reproduce the sound of virtually any electric guitar ever manufactured.

A typical 2-pickup guitar (or bass) uses a 3-way switch to select either pickup #1 (bridge), pickup #2 (neck), or both pickups to produce a total of three pickup tones. This invention permits a 2-pickup guitar to produce 6 unique pickup tones, a 100 percent increase in the number of unique pickup tones.

BRIEF DESCRIPTION OF THE SEVERAL VIEWS OF THE DRAWINGS

FIG. 1 Revised Schematic For 3-Pickups;

FIG. 2 Wiring Diagram For 3-Pickups;

FIG. 3 Revised Schematic For 2-Pickups;

FIG. 4 Wiring Diagram For 2-Pickups;

FIG. 5 Revised Schematic For 2-Pickups (using existing 3-way switch);

FIG. 6 Wiring Diagram For 2-Pickups (using existing 3-way switch);

FIG. 7 Switch Table—identifies which pickup(s) is/are affected by a particular switch.

DETAILED DESCRIPTION OF THE INVENTION

Pickup phase—Electrically, each pickup coil has a polarity. Single coil pickups have two wires connected to the coil. One wire (usually white) is connected to the positive end of the coil and the other wire (usually black or shield) is attached to the negative end of the coil. Because of this, pickups can be connected so they are either in-phase or out-of-phase, which is a description of the pickup coil's polarity in the circuit. When two or more pickups are connected in-phase, the resulting sound is determined by the impedance of each "live" pickup. Pickup coils which are connected out-of-phase will tend to partially cancel the output of the lower tones while producing a more hollow, "tinnier" sound.

Pickup connection—Pickups can also be connected in either a series or parallel arrangement. Pickups which are connected in a parallel arrangement will produce a reduced output of about 25% but will also yield greater crispness with brighter high tones. Pickups that are connected in a series arrangement electrically become a "compound" pickup and will produce a higher output and a more intense sound. Series pickups which are in-phase will produce a strong tone, while out-of-phase series pickups will yield a different tone. Slightly different results are obtained with parallel pickups which are in-phase as compared to when they are out-of-phase.

This method makes use of multiple switches to obtain the additional tones from the guitar pickups.

For a 3-pickup guitar, three double-pole, double-throw (center off) switches are used to serve as Phase Switches. These switches are referred to as SW-1, SW-2 and SW-3. As illustrated in FIG. 1 and FIG. 2, these switches are wired so they can selectively turn off/on each individual pickup in the circuit. They are also used to select a specific pickup's "on state" as being either in-phase or out-of-phase. Each switch is wired to a pickup to control that pickup's "on state". SW-1 is used to control the bridge pickup, SW-2 is used to control the middle pickup, and SW-3 is used to control the neck pickup.

In addition, three additional double-pole, double-throw (no center off) switches to serve as Connection Switches. These switches are referred to as SW-4, SW-5 and SW-6. As illustrated in FIG. 1 and FIG. 2, these switches are wired so they can be used to select whether any of the three pickups are connected in parallel or in series. SW-4 is used to electrically connect the bridge pickup and the middle pickup in series. SW-5 is used to electrically connect the bridge pickup and the neck pickup in series. SW-6 is used to electrically connect the middle pickup and the neck pickup in series. Both SW-4 and SW-6 together put all three pickups in series (SW-5 has no effect in this circumstance).

By using both the Phase Switches and the Connection Switches, 29 different pickup tones may be obtained—significantly increasing the versatility of the 3-pickup guitar which normally will permit only 5 different pickup tones. For wiring and schematic information, refer to FIG. 1 and FIG. 2. Also refer to FIG. 7—Switch Table—to identify which pickup(s) is/are affected by a particular switch.

For a 2-pickup guitar, two double-pole, double-throw (center off) switches are used to serve as Phase Switches. In this instance, the switches used are referred to as SW-1 and SW-3. As illustrated in FIG. 3 and FIG. 4, they are used to selectively turn on/off each individual pickup in the circuit, and are used to select a specific pickup's on state—either in-phase or out-of-phase. In addition, one double-pole, double-throw (no center off) switch serves as the Connection Switch. This switch is referred to as SW-5. This switch is used to select whether the two pickups will be connected in parallel or in series. By using both the Phase Switches and the Connection Switches, 6 different pickup tones may be obtained—increasing the versatility of the 2-pickup guitar which normally will provide 3 different tones. This configuration is preferred to the configuration described in the following paragraph because it allows the guitarist to independently turn on/off each pickup. For wiring and schematic information, refer to FIG. 3 and FIG. 4. Also refer to FIG. 7—Switch Table—to identify which pickup(s) is/are affected by a particular switch.

The 2-pickup guitar can also use the existing 3-way selector switch to reduce the additional switches to one Phase Switch (SW-1) and one Connection Switch (SW-5) to produce the same 6 different pickup tones. However, this configuration has no provision to turn the pickups off. For wiring and schematic information, refer to FIG. 5 and FIG. 6.

FIG. 7—Switch Table identifies how the different pickup tone combinations are derived for the 3-pickup guitar and the 2-pickup quitar. The Phase Switches identify the parallel connection in the circuit or each pickup. For example, SW-1*a* represents the in-phase circuit, and SW-1*b* represents the out-of-phase circuit. The Connection Switches identify the series conncetion in the circuit for each pickup. [See FIG. 7—Switch Table for complete details]

What is claimed is:

1. A guitar pickup switching system for a three-pickup guitar, comprising:

a first single-coil or a multiple-coil bridge pickup, a second single-coil or a multiple-coil middle pickup;

a third single-coil or a multiple-coil neck pickup; and a switching means consisting of three double-pole, double-throw (center off) switches and three double-pole, double throw (no center off) switches for selecting outputs of said pickups to provide all of the following combinations:

(01) a connection consisting of the first pickup alone,

(02) a connection consisting of the second pickup alone,

(03) a connection consisting of the third pickup alone,

(04) a connection consisting of the first pickup and the second pickup connected in parallel and in-phase,

(05) a connection consisting of the first pickup and the third pickup connected in parallel and in-phase,

(06) a connection consisting of the second pickup and the third pickup connected in parallel and in-phase,

(07) a connection consisting of the first pickup and the second pickup and the third pickup connected in parallel and in-phase,

(08) a connection consisting of the first pickup and the second pickup connected in parallel and out-of-phase,

(09) a connection consisting of the first pickup and the third pickup connected in parallel and out-of-phase,

(10) a connection consisting of the second pickup and the third pickup connected in parallel and out-of-phase,

(11) a parallel connection consisting of the first pickup, the second pickup, and the third pickup; the first pickup is out-of-phase with both second and third pickups,

(12) a parallel connection consisting of the first pickup, the second pickup, and the third pickup; the third pickup is out-of-phase with both the first and second pickups,

(13) a parallel connection consisting of the first pickup, the second pickup, and the third pickup; the second pickup is out-of-phase with both the first and third pickups,

(14) a connection consisting of the first pickup and the second pickup connected in series and in-phase,

(15) a connection consisting of the first pickup and the third pickup connected in series and in-phase,

(16) a connection consisting of the second pickup and the third pickup connected in series and in-phase,

(17) a connection consisting of the first pickup and the second pickup and the third pickup connected in series and in-phase,

(18) a connection consisting of the first pickup and the second pickup connected in series and out-of-phase,

(19) a connection consisting of the first pickup and the third pickup connected in series and out-of-phase,

(20) a connection consisting of the second pickup and the third pickup connected in series and out-of-phase,

(21) a connection consisting of the first pickup, the second pickup and the third pickup connected in series; the first pickup out-of-phase with both the second pickup and the third pickup,

(22) a connection consisting of the first pickup, the second pickup and the third pickup connected in series; the third pickup out-of-phase with both the first pickup and the second,

(23) a connection consisting of the first pickup, the second pickup and the third pickup connected in series; the second pickup out-of-phase with both the first pickup and the third pickup,

(24) a connection consisting of the first pickup and the second pickup connected in series and in-phase; the third pickup connected parallel to both the first and second pickups and in-phase with the first pickup,

(25) a connection consisting of the first pickup and the third pickup connected in series and in-phase; the second pickup connected parallel to both the first and third pickups and in-phase with the first pickup,

(26) a connection consisting of the second pickup and the third pickup connected in series and in-phase; the first pickup connected parallel to both the second and third pickups and in-phase with the second pickup,

(27) a connection consisting of the first pickup and the second pickup connected in series and out-of-phase; the third pickup connected parallel to both the first and second pickups and in-phase with the first pickup,

(28) a connection consisting of the first pickup and the third pickup connected in series and out-of-phase, the second pickup connected parallel to both the first and third pickups and in-phase with the first pickup,

(29) a connection consisting of the second pickup and the third pickup in series and out-of-phase; the first pickup connected parallel to both the second and third pickups and in-phase with the second pickup.

2. A guitar pickup switching system as defined in claim 1, further comprising:

one variable resistor to serve as a volume control to collectively control the volume of all three pickups.

3. A guitar pickup switching system as defined in claim 2, further comprising:

one variable resistor with capacitor to serve as a tone control to collectively control the tone of all three pickups.

* * * * *